US005177550A

United States Patent [19]

Uehara et al.

[11] Patent Number: 5,177,550

[45] Date of Patent: Jan. 5, 1993

[54] FIXING APPARATUS HAVING A RELEASANT REMOVAL MEANS

[75] Inventors: Yasuhiro Uehara; Kazuhiko Miyazato; Ryuji Katsuno; Hideo Saito, all of Ebina, Japan

[73] Assignee: Fuji Xerox, Co., Ltd., Tokyo, Japan

[21] Appl. No.: 738,091

[22] Filed: Jul. 30, 1991

[30] Foreign Application Priority Data

Jul. 31, 1990 [JP] Japan ..... 2-203060

[51] Int. Cl.[5] ..... G03G 15/20

[52] U.S. Cl. ..... 355/284; 118/DIG. 1

[58] Field of Search ..... 355/282-284; 118/60, DIG. 1; 219/216

[56] References Cited

U.S. PATENT DOCUMENTS 4,231,653 11/1980 Nagahara et al. ..... 118/60 X
4,541,707 9/1985 Yoshinaga ..... 355/284
4,956,211 9/1990 Saito ..... 428/36.5

FOREIGN PATENT DOCUMENTS 0203470 11/1983 Japan ..... 355/284
0207171 10/1985 Japan ..... 355/284

*Primary Examiner*—A. T. Grimley
*Assistant Examiner*—William J. Royer
*Attorney, Agent, or Firm*—Finnegan, Henderson, Farabow, Garrett and Dunner

[57] ABSTRACT

A heated roller type of fixing device to prevent offsetting of toner onto a fixing or pressure roller and an imaging system including such a fixing device wherein a sheet with toner deposits thereon is passed between a fixing roller and a pressure roller to fix the toner in place, a releasant applicator applies a releasant on the surface of at least one of said fixing or pressure rollers, and a releasant remover removes from the sheet the releasant deposited thereon by the fixing or pressure roller, thereby the releasant remaining on the toner image is removed by the releasant remover. Thus, it is possible to eliminate image density variations which may otherwise be caused by an uneven distribution of the releasant, as is the case with the prior art, and to obtain an image density which does not change with time and so is stable.

25 Claims, 5 Drawing Sheets

FIXING APPARATUS HAVING A RELEASANT REMOVAL MEANS

BACKGROUND OF THE INVENTION

The present invention relates to a fixing device for fixing toner images in electrophotographic copying machines or other equipment and an imaging system in which such a fixing device is built and, more particularly, the present invention relates both to a heated roller type fixing device designed to be coated thereon with a releasant for preventing "offsetting" of toner onto a fixing or pressure roller and to an imaging system with such a fixing device built in it.

It has so far been known in the art that a part of the releasant (oil) fed to the fixing or pressure roller is transferred onto copying paper when the paper is fixed with a heated roller type fixing device. The oil transferred onto the copying paper diffuses for a relatively short period of time into the fibers of the copying paper through and amongst the toner particles or through pinholes. The oil which is transferred onto a toner image-free surface portion of the paper, i.e., the oil transferred directly onto the surface of the paper, also diffuses into the paper's fibers in a similar manner as mentioned above, but the releasant produces no appreciable influence on the resulting image.

However, a fixing device—used with a color copying machine, esp., one designed to reconstruct a multicolor image by superposition of three- or four-color toners—is significantly different from that used with a conventional, black & white type copying machine for the following reasons:

(1) the toners must be fixed in the form of a thick layer so as to reconstruct a multicolor image by superposition; and (2) the toners, differing in color, must be heated well and fluidized so as to develop colors by fixing and color mixing.

These are likely to present conditions under which the fixing device brings about such an offsetting phenomenon as already referred to.

In order to avoid such offsetting, it is required for a color copying machine to have a fixing device with a high releasability. To this end, use may be made of a fixing device including a fixing roll which is coated thereon with a rubbery elastomer such as silicone rubber and to which a large amount of a releasant, i.e., silicone oil is fed in the form of a release layer.

Feeding a large amount of silicone oil to the fixing roll, however, results in the presence of a considerable amount of silicone oil on the surface of the sheet which also has a thick toner layer thereon. This silicone oil is, in turn, left on the toner surface over a relatively long period of time without diffusing into the paper fibers, because the toner particles have been well fused into coalescence. The oil cannot pass through the coalesced toner into the paper. When fingers come in contact or touch with such an image, there will be left fingerprints or other stains. The amount of oil residue changes gradually with the passage of time; this means that both the density and gloss of the image decrease with time, making the image unstable.

When the toner layer cracks by external force, i.e., by the expansion and shrinkage or deformation of the paper by moisture absorption, the oil diffuses relatively quickly into the paper fibers through the cracks, so that the toner layer separates into two regions, one having the oil thereon and the other not. The region having the oil thereon has a high image density, but the region having no oil thereon has a low image density. Thus, even though the image is initially of uniform density, it will suffer density variations due to an uneven distribution of oil and so will become unpleasant to look at.

In view of the foregoing, an object of this invention is to provide a fixing device capable both of eliminating image density variations which may otherwise be caused by an uneven distribution of a releasant remaining on the surface of the toner on the copying paper and of assuring an image density which does not change with the lapse of time and so is stable. It is another object to provide an imaging system in which such a fixing device is incorporated.

SUMMARY OF THE INVENTION

The present inventors have now found that the removal of releasant residues from the surface of the toner after fixing may be adequately accomplished by bringing a relatively soft, rubbery elastomer into contact with the surface of the resulting image. The present inventors have also confirmed that the releasant, for the most part, is transferred onto the elastomer with only a trace of the releasant remaining on the surface of the toner. As a result the image cannot substantially suffer variations in density and gloss or changes-with-time. The device for bringing such a rubbery elastomer in contact with the post-fixing image is designed such that the post-fixing sheet passes between one or more pairs of rollers adapted to be rotated in contact with each other under pressure, at least the roller or rollers located on the fixed image side being coated thereon with a rubbery elastomer or elastomers all over a region wider than the width of the sheet. The rubbery elastomers used, for instance, may include general-purpose rubber materials such as silicone rubber, fluororubber, EPDM, urethane rubber, NBR and ABS rubber, but the greatest preference is given to silicone rubber.

Usually, the releasant used is silicone oil. The silicone rubber, because of good compatibility with silicone oil, can effectively receive silicone oil from the surface of toner.

More specifically, the fixing device according to this invention is characterized by including a fixing roller and a pressure roller between which a sheet with toner deposits carried thereon is passed to fix the toner in place, releasant applicator means for applying a releasant on the surface of at least one of said fixing and pressure rollers, and a releasant remover means for removing from said sheet the excess releasant deposited thereon through said fixing roller after having left both of the rollers.

In this case, the releasant remover means may be composed of a pair of releasant removing rollers which rotate with respect to each other, a pair of releasant removing belts which rotate with respect to each other, or a releasant removing roller and a releasant removing belt which rotate with respect to each other any and all of. Alternatively, the releasant remover means may be constructed from plural pairs of releasant removing rollers which rotate with respect to each other, any and all of which are located in the sheet feed direction.

When the releasant removing means is composed of a pair of releasant removing rollers, it is desired that the rollers each include a core with elastomer coating thereon. It is noted, however, that a pair of releasant removing rollers should each have a length larger than the maximum sheet width.

When the releasant remover means is composed of plural pairs of releasant removing rollers which rotate with respect to each other, the rollers are alternately displaced in the direction at right angles with the sheet feed direction. Moreover, one pair of the releasant removing rollers has a length shorter than the maximum sheet width but slightly longer than other shorter sheet width, and the rollers are preferably located at such a position that their edges coincide or overlap slightly with that of the other pair of releasant removing rollers in the direction at right angles with the sheet feed direction.

When a pair of releasant removing rollers are each composed of a core with an elastomer coating thereon, it is desired that the releasant and elastomer be formed of silicone oil and silicone rubber, respectively.

This invention also provides an imaging system with the above-mentioned fixing device incorporated therein, which further includes a developing unit for depositing toners of plural colors on the associated sheet a superimposed relation.

As mentioned above, this invention provides a fixing device including a fixing roller and a pressure roll between which a sheet with toner deposits carried thereon is passed to fix the toner in place, a releasant applicator means for applying a releasant on the surface of at least one of the fixing and pressure rollers, and a releasant remover means for removing from said sheet the releasant deposited thereon through said fixing roller after having left both said rollers, whereby the releasant remaining on the toner image is removed by the releasant remover means. Thus, it is possible to eliminate image density variations which may otherwise be caused by an uneven distribution of the releasant, as is the case with the prior art, and obtain an image density which suffers no change with time and so is stable. It is also possible to eliminate variations in removing the releasant due to changes with time in the releasant remover means by arranging a plurality of such releasant remover means in the sheet feed direction.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

DESCRIPTION OF THE PREFERRED EMBODIMENTS

The fixing device according to this invention and the imaging system in which this fixing device is built will now be explained in more detail with reference to the accompanying drawings, but the device is not exclusive to those depicted in the accompanying drawings.

Figure 1:
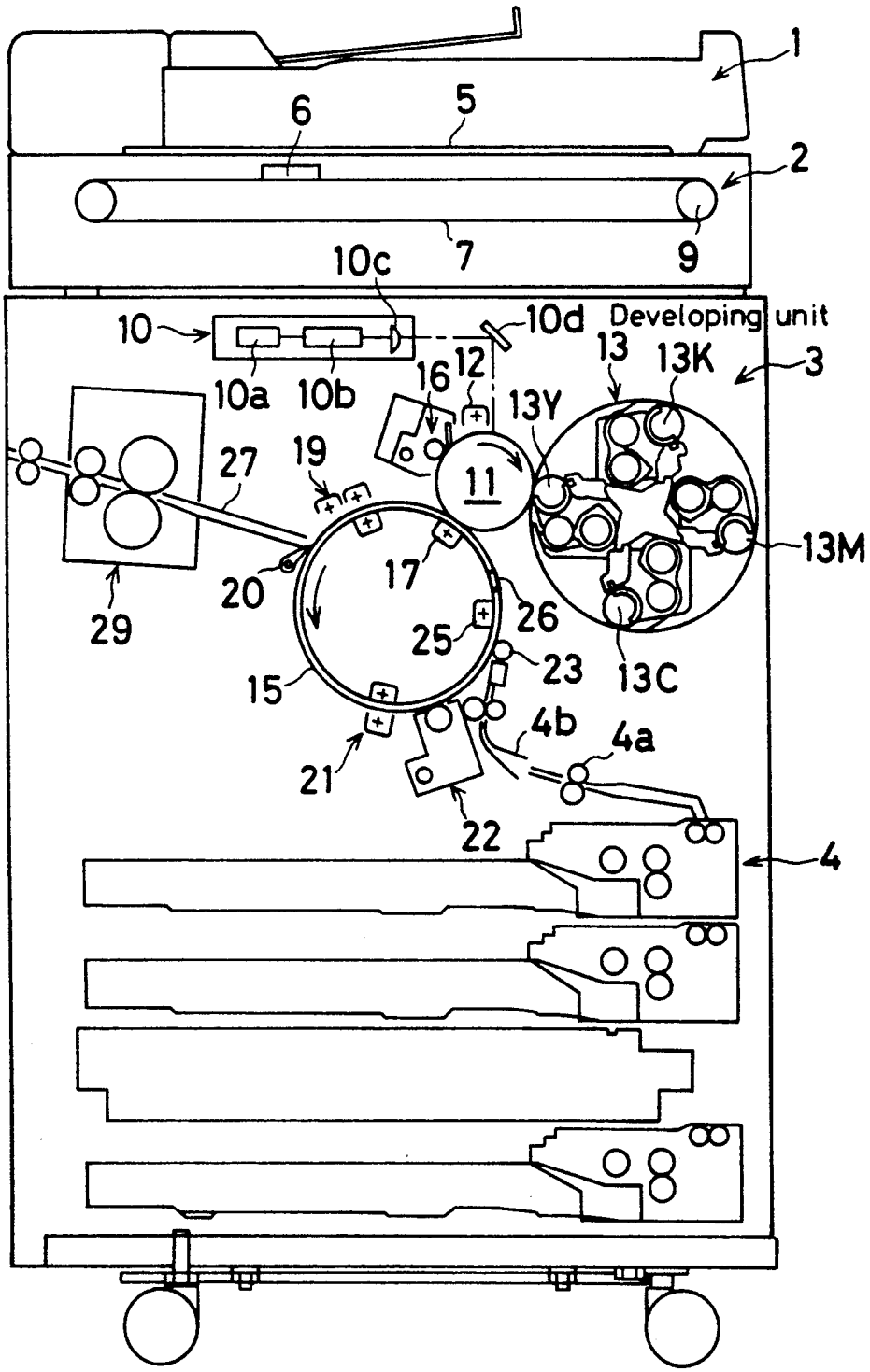
FIG. 1 is a schematic view showing an example of a color electrophotographic type of copying machine to which the imaging system using the fixing device according to this invention is applied.

FIG. 1 is a schematic view showing one arrangement of a color electrophotographic type of copying machine to which the imaging system using the fixing device according to this invention is applied. It is understood that this invention is applicable not only to such a color electrophotographic type of copying machine but also to an imaging system of the type designed to transfer a succession of images on a single sheet.

The color electrophotographic type of copying machine is composed of an automatic original image feeder 1, an image input 2, an image output 3 and a sheet feeder 4. The color original image is set on a platen glass 5 through the automatic feeder 1. The image input 2 is composed of an imaging unit 6, a wire 7 for driving said unit, a driving pulley 9 and other parts. A four-color or full-color original image, for instance, is read with a CCD line sensor and a color filter, both incorporated in the imaging unit 6. The color filters are B (blue), G (green) and R (red) which are the primary colors of light. The outputs are then converted into digital image signals, which are in turn converted into Y (yellow), C (cyan), M (magenta) and K (black) which are the primary colors of toner. Subsequently, various data processes are carried out so as to enhance the reproducibility of color, gradation, fineness and other factors. Gray-scale color toner signals are converted into on-off binary signals, which are then fed to the image output 3.

The image output 3 includes a scanner 10 and a photosensitive material drum 11 (hereinafter called the photosensitive drum). The drum 11 is provided thereround with an electrical charger 12 for electrically charging the drum 11 uniformly, a developing unit 13 for developing an electrostatic latent image with toner to form a toner image, and a transfer drum 15 for transferring the toner image onto a sheet and a cleaner 16 for recovering toner residues that are not used for toner development. The drum is driven by an electrically powered motor in a rotational direction shown by an arrow.

In a laser output 10*a* of the scanner 10, for instance, yellow image signals coming from the image input 2 are converted into optical signals to form a latent image corresponding to the original image on the photosensitive drum 11. The latent image is formed through a polygonal mirror 10*b*, an f/$\theta$ lens 10*d* and a reflecting lens 10*c*. Once the yellow latent image has been transferred onto the sheet through development, the drum 11 is cleared of toner residue by the cleaner 16. After which, next, the drum 11 is electrically charged by the charger 12, permitting the laser output 10*a* to output cyan image signals. Similarly, the respective image signals of magenta and black are processed into corresponding latent images. It is understood that in addition to the above-mentioned system where latent images are formed on the photosensitive drum with the laser scanner, there is also available a process wherein light transmitted through original images is exposed directly to the photosensitive drum through optical systems for scanning and color separation.

The developing unit 13 includes processors 13Y, 13C, 13M and 13K for yellow, cyan, magenta and black, respectively, which are all located around a rotating shaft thereof. A yellow toner image, for instance, may be formed by carrying out development with the processor 13Y for yellow at the illustrated position, as shown in FIG. 1. And in order to form a cyan toner image, the developing unit 13 may be rotated to locate the processor 13C for cyan to a position adjacent to the drum 11. Magenta and black toner images may also be formed in similar manners as mentioned above.

The transfer drum 15 is laminated thereon with a dielectric film or a mesh screen, and is driven in a rotational direction shown by an arrow. The transfer drum 15 is driven either by an exclusive electric-powered motor or the photosensitive drum 11 connected thereto by way of a gear. Around the transfer drum 15, there is an electrical charger 17 for transfer, an electrical charger 19 for separation, a release finger 20, a charge eliminator 21, a cleaner 22, a pressing roller 23 and an electrical charger 25 for suction. A sheet fed from the sheet feeder 4 through a feed roller 4*a* and a feed guide 4*b* is held by a gripper 26, fixed to the transfer drum 15 and retained by the dielectric film or mesh screen through the corona of the charger 25. The transfer drum 15 is so rotated in tune with the photosensitive drum 11 that yellow-developed toner image, for instance, is transferred onto the sheet by the charger 17 for transfer. In this manner, other colors are successively transferred onto the sheet by the rotation of the transfer drum 15.

After the transfer drum is rotated four times to complete the transfer of each of the four colors, the sheet is A. C. cleared of charges by the chargers 19 located on the outside and inside of the transfer drum 15, is separated by the release finger 20, and is carried by a delivery belt 27 to a fixing device 29, where the toner image is thermally fixed to complete the copying cycle.

Figure 2:
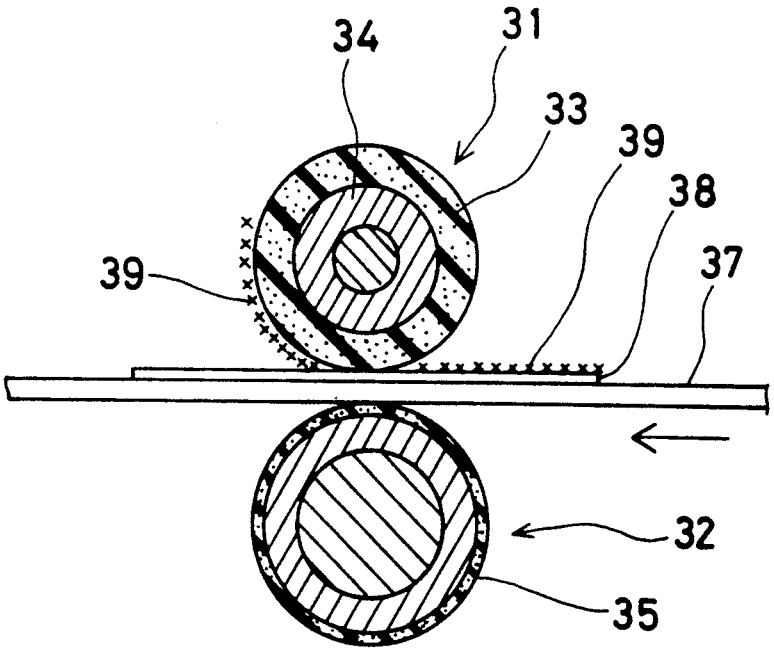
FIG. 2 is a sectional view of the basic construction of the oil remover located in the rear of a fixing roll.

FIG. 2 shows a sectional view of the basic construction of an oil remover located in the rear of the fixing roller of the fixing device 29. This oil remover is composed up of a pair of rollers adapted to rotate in contact with each other. A roller 31 located on the image side of a sheet 37 is coated thereon with a relatively thick layer 33 of silicone rubber, while a roller 32 located on the back side thereof is coated thereon with a relatively thin layer 35 of the same silicone rubber. Both of the rollers 31 and 32 are provided therebetween with a nip which is primarily defined by the surface deformation of the roller 31. In this arrangement, the sheet 37 tends to curl down. However, if both the rollers are located upside down to forcibly curl up the sheet, this arrangement may then be applicable to sheets which have their own property of curling down.

A toner image 38 is deposited on a sheet 37 with a releasant 39 which has been transferred from the fixing device. However, the releasant 39 is transferred onto the surface of the roller 31 during the passage of the sheet through the nip; after leaving the rollers 31 and 32, the surface of the toner 38 is nearly cleared of the releasant 39. When a succession of sheets 37 are fed continuously, the releasant 39 is transferred from the roller 31 onto the surface of the opposite roller 32 after one sheet has passed through the nip and before the next sheet 37 reaches the nip. In addition, the thus deposited releasant 39 is transferred onto the next sheet when it passes through the nip. Even when a succession of sheets are continuously fed through the nip, it is thus possible to remove the releasant 39 on the toner image 38 in a stable manner, without the accumulation of the releasant on the surfaces of both the rollers 31 and 32.

The thin layer 35 of silicone rubber is coated on the surface of the roller 32 to increase incrementally the proportion of the releasant transferred from the roller 31 onto the roller 32 and from the roller 32 onto the back side of the next sheet passing through the nip. In some cases, only a metal or plastic roller may be used for this roller.

This releasant remover may also serve as taking-off equipment after fixing. In addition, it may contain a cleaning member such as a web or roller to clean the surfaces of the roller 31 and 32.

In order to prevent sheets from wrinkling through the releasant remover, it is desired that the load applied between the two rollers 31 and 32 be reduced as much as possible. To this end, the rubbery elastomer layers 33 and 35 may each be formed of a multi-layer, hybrid material comprising a sponge and a rubber layer laminated on the surface thereof, thus making it possible to obtain a wide nip span at a decreased load.

In order to prevent electrical charging by friction from occurring between the sheet and the elastomer rubber layers 33 and 35, the rubber material may additionally contain such additives as antistatics, surfactants and electrically conductive fillers. Alternatively, antistatic means may be provided on the surfaces of the rollers.

Figure 3:
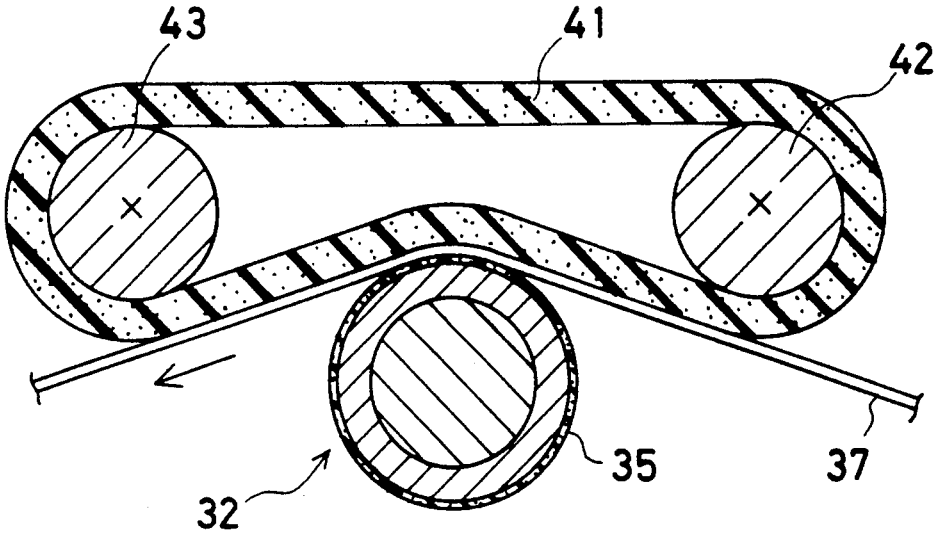
FIG. 3 is a sectional view of another embodiment of the oil remover.
Figure 4:
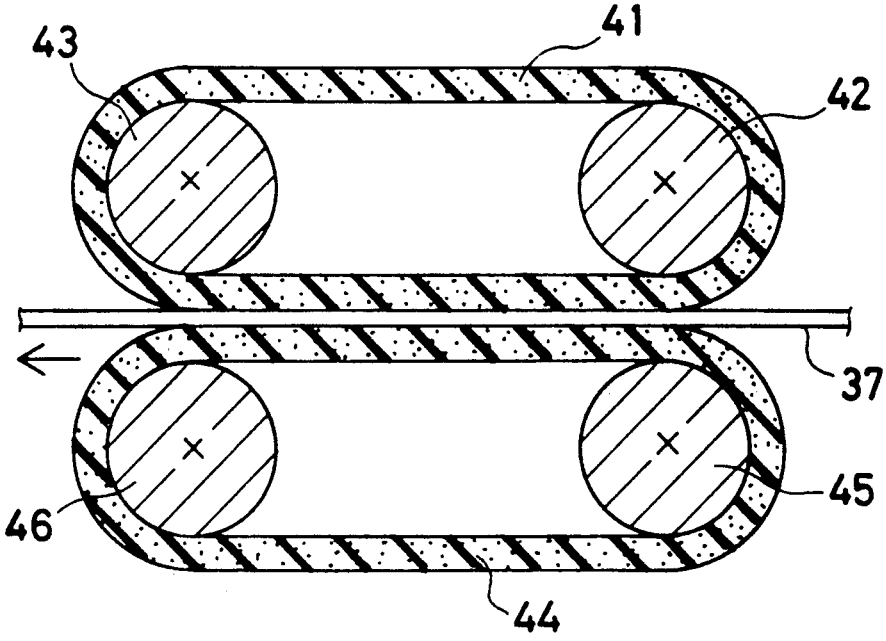
FIG. 4 is a sectional view of a further embodiment of the oil remover.

While the releasant remover has been described specifically as constructed from a pair of roller, this invention is not limited thereto. For instance, it may be composed of an elastomer belt used in combination with a roller or another belt. FIG. 3 shows another embodiment of the releasant remover wherein a belt 41 of silicone rubber provided round driving rollers 42 and 43 is used on the image side of a sheet 37 in place of a roller. FIG. 4 illustrates a further embodiment of the releasant remover wherein belts 41 and 44 of silicone rubber provided round driving roller 42 and 43 and 45 and 46, respectively, are used on both the image and back sides of a sheet 37. These two embodiments are equivalent in action to the first embodiment shown in FIG. 2. However, both the FIGS. 3 and 4 embodiments come in contact with the sheet 37 over an area so increased that the releasant can be transferred from the sheet 37 more effectively.

In the case of the above-mentioned oil removers, the lengths of the rollers 31 and 32 and the widths of the belts 41 and 44 are all made slightly larger than the maximum size of copying paper (e.g. the longitudinal length of an A4 sheet). However, when a succession of sheets of shorter width (e.g. B5 sheets to be fed in the lengthwise direction) are copied continuously, the surface rubber layers 33 and 35 of the rollers 31 and 32 or the rubber belts 41 and 44 are permitted to work in only their narrow nip areas to remove oil (e.g. silicone oil). As a result, only the rubber found in the nip areas is so swollen with the oil to be removed that it is larger in diameter and thickness than the rest. When this swelling is too increased, the rollers, the rollers and belt or the belts are unlikely to come in contact with each other, failing to form the nip and so remove the releasant.

Figure 5:
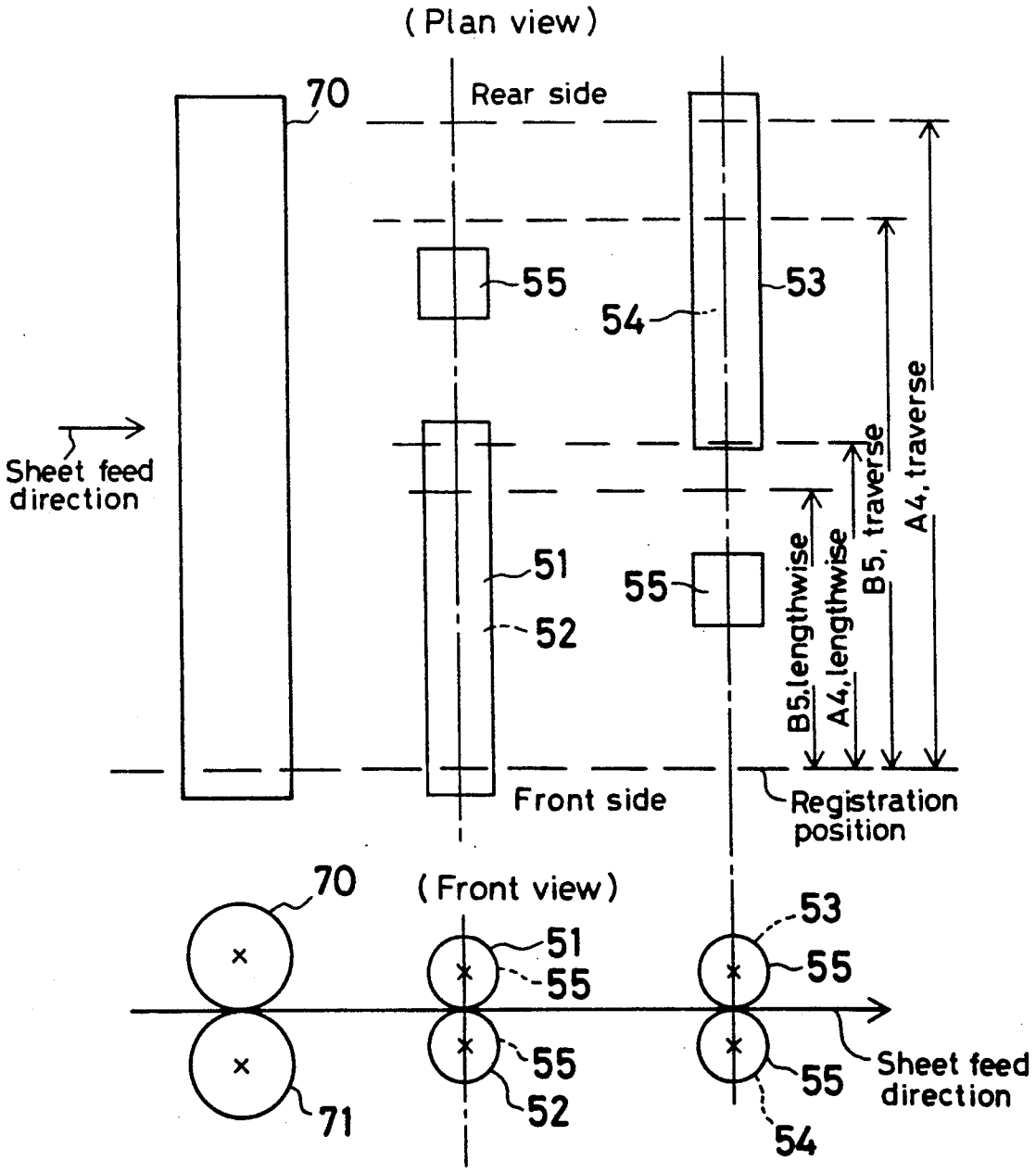
FIG. 5 is a grammatical view for illustrating an arrangement of the present system in which two oil removers are used.

Such a problem is solved by a still further embodiment of the releasant remover wherein, as illustrated in plan and front views presented as FIG. 5, one or a first remover comprising an oil removing roller 51 and a roller 52 opposite thereto is displaced in a zigzag form with respect to another or a second remover comprising an oil removing roller 53 and a roller 54 opposite thereto in the downstream or sheet-feed direction of a fixing roller 70, with the edges of both the removers overlapping slightly each other in the traverse direction to the sheet feed direction. There are also provided delivery rollers 55 for helping to deliver the sheet, which are located at positions on lines extending from the first and second removers. It is noted that the arrangement illustrated is designed, primarily but not exclusively, for feeding A4 sheets in the lengthwise direction, and that in use, all kinds of sheets must be registered alongside the front side position (registration position) prior to feeding. In this case, the length of the oil removing roller 51 of the first remover is made slightly longer than that shorter side (210 mm) of A4 sheets, and when A4 sheets are fed in the lengthwise direction, it is by this roller 51 that oil is cleared thereof. This is also true of when shorter B5 sheets (182 mm) are fed in the lengthwise direction. Then, the edge—located on the rear side of the system—of the oil removing roller 53 of the second remover projects slightly from the rear side of the system for feeding A4 sheets in the traverse direction, and the edge thereof—opposite to the front side of the system—is located at such a position that it coincides with or projects slightly from the side—along which A4 sheets are fed in the lengthwise direction—in the direction at right angles with the sheet feed direction. Thus, even though the rollers 51 and 52 are swollen in the case of feeding B5 and A4 sheets larger than the length of A4 sheets in the traverse direction, a portion of the oil commensurate to the A4 lengthwise size is removed by the first remover and the rest is done by the rollers 53 and 54 of the second remover, whereby the above-mentioned problem can be solved. It is noted that the opposite rollers 52 and 54 may be equal or slightly longer in length to or than the associated oil removing rollers 51 and 53. It is also noted that the oil removing rollers 51, 53 and the rollers 52, 54 opposite thereto may be of the same structure and formed of the same material so as to facilitate their production and assembling and increase their service life. The delivery rollers 55 may also be either formed of the same material as the rollers 51-54 or built up of a general-purpose type of delivery rollers.

While the releasant has been described as removed by the roller pair or pairs, this may also hold for such arrangements as shown in FIGS. 3 and 4. It is understood that when the registration position is located at the axial center of the photosensitive drum, it is required that the second and third removers be located on the downstream side of the first remover. It is also understood that the arrangement of FIG. 5 may be divided into three or more parts for providing three or more removers.

The fixing device—in which the oil remover shown in FIG. 2 is incorporated—will now be explained more illustratively.

Figure 6:
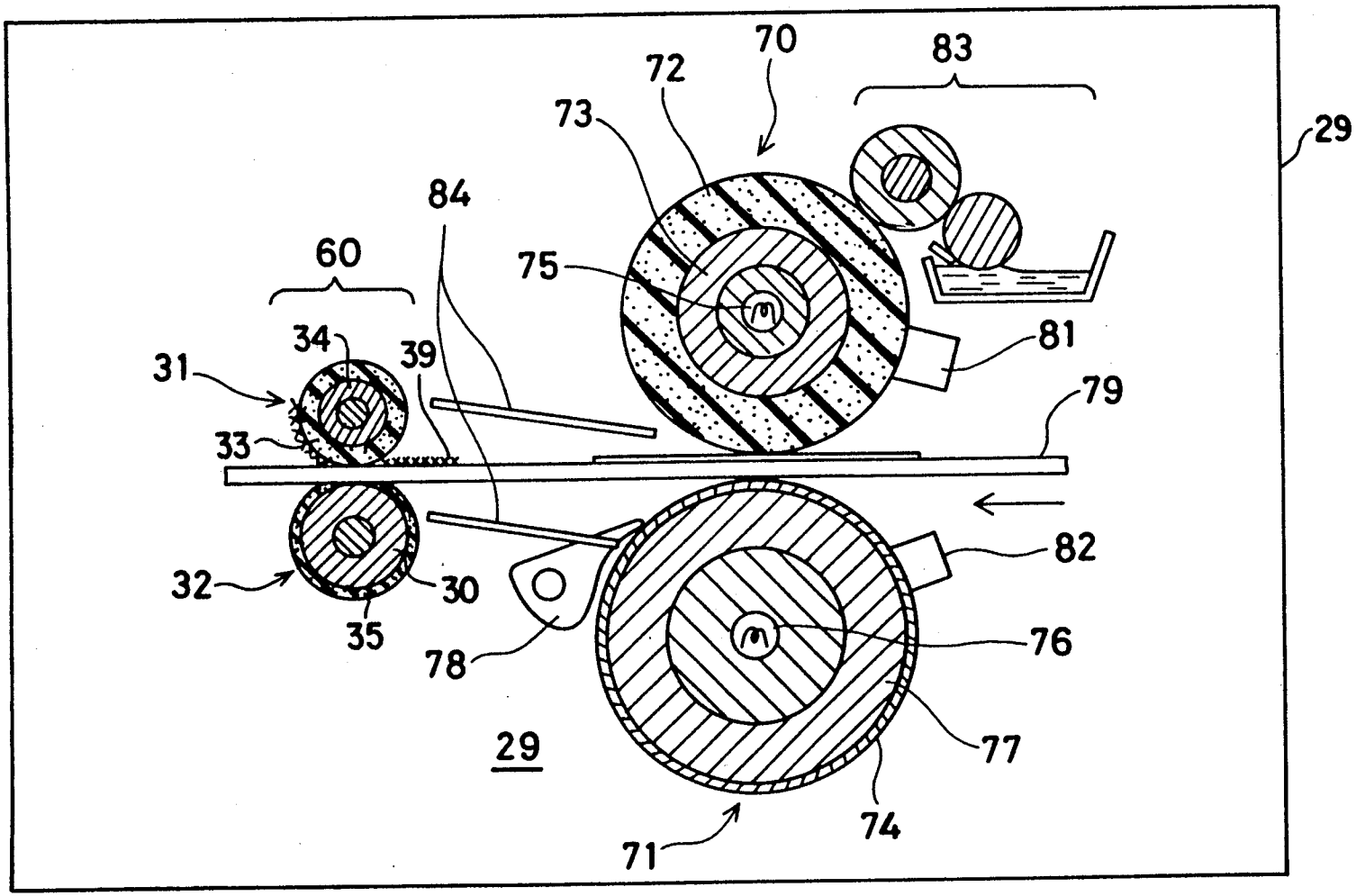
FIG. 6 is a sectional view of one embodiment of the fixing device according to this invention.

FIG. 6 is a sectional view of one embodiment of the fixing device 29, wherein reference numeral 70 stands for a fixing roller 70 formed of an elastomer roller which has a diameter of 50 mm and is built up by coating an aluminium core 73 with a 3-mm thick silicone rubber layer 72, said core 73 including therein an infrared lamp 75 serving as a heat source. The surface temperature of the fixing roller 70 is sensed by a temperature sensor 81 and controlled to 175° C. by a temperature control circuit, although not shown.

A press roller 71 of 50 mm in diameter is built up of an aluminium core 77 coated thereon with a 50-μm thick Teflon (a commercial product made by Du Pont Co., Ltd.) layer 74, said core 77 again including therein an infrared lamp 76 serving as a heat source. The surface temperature of the press roller 71 is sensed by a temperature sensor 82 and maintained to 165° C. by a temperature control circuit, although not illustrated.

Both the rollers 70 and 71 are brought in contact with each other under a load of 80 Kg through a nip span of 5 mm, and are mutually driven at a speed of 160 mm/second.

Referring to FIG. 6, it is noted that reference numeral 78 represents a release claw forming means for releasing a sheet wound round the pressure roller 71; 83 means for supplying to the fixing roller 70 silicone oil that is the releasant, which may be selected from various known types; and 84 a paper chute.

A sheet 79—on which four toners of cyan, magenta, yellow and black have been transferred by such a color electrophotographic copying machine as illustrated in FIG. 1 but which has been unfixed—is fixed between both the rollers 70 and 71 and permitted to develop colors to form a color image, and then guided to the releasant remover 60. As already explained with reference to FIG. 2, the remover 60 is built up of a pair of the elastomer rollers 31 and 32, said roller 31 including the aluminium core 34 coated thereon with the silicone rubber layer 33 (with a rubber hardness of 30 degrees) of 4 mm in thickness while said roller 32 including the aluminium core 30 coated thereon with the same silicone rubber layer 35 of 1 mm in thickness, and both said rollers 31 and 32 being rotated at the same speed as the fixing roller 70 through a nip span of 2.5 mm.

As mentioned above, the releasant 39 remaining on the post-fixing toner images are transferred onto the surface of the roller 31 and thereby removed from the surfaces of the toner images.

Estimation was made of the changes-with-time in the density and gloss of the image fixed with the fixing device 29 of the above-mentioned construction. As can be understood from the data reported in Table 1, given just below, there are no or little changes in terms of both density and gloss. The densitometer and gloss meter used were Macbeth 910 and Gardner Gloss Meter II, respectively. Even after a touch test, no fingerprints were left on the image; this image was found to be stable.

TABLE 1

| What Was Estimated | 0 hr. | 1 hr. | 5 hr. | 1 day | 3 days | 5 days | 7 days | 10 days |
|---|---|---|---|---|---|---|---|---|
| Density | 1.81 | 1.80 | 1.81 | 1.81 | 1.79 | 1.81 | 1.81 | 1.80 |
| Gloss | 77.0 | 76.6 | 76.8 | 76.0 | 76.3 | 76.5 | 76.1 | 75.9 |

On the other hand, similar estimation was made with the above-mentioned fixing device 29 from which the oil remover 60 was detached. As can be appreciated from the data reported in Table 2, given just below, the density and gloss were gradually decreased and it was after the lapse of about five days that they were somehow stabilized.

TABLE 2

| What Was Estimated | 0 hr. | 1 hr. | 5 hr | 1 day | 3 days | 5 days | 7 days | 10 days |
|---|---|---|---|---|---|---|---|---|
| Density | 1.93 | 1.91 | 1.88 | 1.86 | 1.83 | 1.80 | 1.81 | 1.79 |

TABLE 2-continued

| What Was Estimated | 0 hr | 1 hr | 5 hr | 1 day | 3 days | 5 days | 7 days | 10 days |
|---|---|---|---|---|---|---|---|---|
| Gloss | 87.5 | 84.5 | 83.0 | 81.0 | 79.3 | 76.7 | 77.0 | 76.9 |

The results of a 50-member panel, organoleptic testing conducted as to density variations are set out in Table 3. Almost all the panel members responded that with the present fixing device including the oil remover 60, no problem was found at all as to density variations, but they indicated that with the fixing device including no oil remover 60, the density variations reached a maximum at 1 day after fixing. Such density variations decreased gradually later and it was after the lapse of 1 week that a level virtually unnoticeable without close examination was reached.

TABLE 3

| What Was Estimated | 0 hr. | 1 hr. | 5 hr | 1 day | 3 days | 5 days | 7 days | 10 days |
|---|---|---|---|---|---|---|---|---|
| With the Remover | 1.5 | 1.7 | 1.7 | 1.3 | 1.8 | 1.2 | 1.5 | 1.4 |
| Without the Remover | 1.4 | 3.1 | 4.2 | 4.5 | 4.0 | 3.3 | 2.5 | 1.8 |

The data was obtained by averaging 50 responses.

Note:

Grade

1: Unnoticeable

2: Unnoticeable without close examination

3: Noticeable but less unpleasant to look at

4: Unpleasant

5: Badly unpleasant

When the fixing device 29—from which the oil remover 60 was detached—was used, the density and gloss of the resulting image were high at an early stage and decreased later, as indicated in Table 2. This is due to the fact that the silicone oil—which remains on the toner's surface as a film after fixing—diffuses into the sheet through cracks in the toner layer, the interfaces of toner particles which may exist locally, or pinholes. Thus, during the period of 1 hour to fifth day after fixing, portions of the image around cracks in the toner layer, the interface of toner particles and pinholes are lower in density than the rest, making the image unpleasant to look at due to the presence of density variations, as indicated in Table 3.

As explained in detail above, this invention provides a fixing device and an imaging system including such a fixing device, which including a fixing roller and a pressure roller between which a sheet with toner deposits carried thereon is passed to fix the toner in place, releasant applicator means for applying a releasant on the surface of at least one of said fixing and pressure rollers, and a releasant remover means for removing from said sheet the releasant deposited thereon through said fixing roller after having left both said rollers whereby the releasant remaining on the toner image is removed by the releasant remover means, whereby it is possible to eliminate image density variations which may otherwise be caused by an uneven distribution of the releasant, as is the case with the prior art, and obtain an image density which does not change with time and so is stable. Thus, this invention is of great industrial value.

It is also possible to eliminate variations in removing the releasant due to changes-with-time in the releasant remover means by arranging a plurality of such releasant remover means in the sheet feed direction.

What is claimed is:

1. A fixing device wherein toner is fixed to a sheet which moves through the fixing device at a predetermined sheet velocity in a sheet feed direction, comprising:

a fixing roller and a pressure roller disposed relative to one another for fixing toner onto the sheet passed therebetween at the sheet velocity;

a releasant applicator means for applying releasant material to one of either the fixing roller or the pressure roller; and releasant removing means having at least a pair of opposing moving surfaces for moving the sheet therebetween, and at least one of the opposing moving surfaces being an elastomeric surface for redistributing the releasant material on the sheet and each successive sheet.

2. A fixing device as claimed in claim 1, wherein said releasant removing means comprises a pair of releasant removing rollers rotatable with respect to each other.

3. A fixing device as claimed in claim 2, wherein the pair of releasant removing rollers each includes a cylindrically-shaped core with an elastomeric surface thereon.

4. A fixing device as claimed in claim 2 for receiving a sheet from a predetermined minimum to a predetermined maximum width, and wherein the pair of releasant removing rollers each have a length longer than the maximum sheet width.

5. A fixing device as claimed in claim 3, wherein the releasant material includes silicone oil and the elastomeric surface includes silicone rubber.

6. A fixing device as claimed in claim 1, wherein said releasant removing means comprises a pair of releasant removing belts movable with respect to each other.

7. A fixing device as claimed in claim 1, wherein said releasant removing means comprises a releasant removing roller and a releasant removing belt rotatable with respect to each other.

8. A fixing device as claimed in claim 1, wherein said releasant removing means comprises a plurality of pairs of releasant removing rollers for rotation with respect to each other, each pair being disposed relative to one another in a sheet feed direction.

9. A fixing device as claimed in claim 8, wherein the plurality of pairs of releasant removing rollers are alternatively displaced in a direction at right angles with the sheet feed direction.

10. A fixing device as claimed in claim 9, wherein the fixing device is operable to receive sheets having a width range between a maximum width and a minimum width, and one of the plurality of pairs of releasant removing rollers has a length less than the maximum sheet width but greater than the minimum sheet width.

11. A fixing device as claimed in claim 9, wherein one pair of releasant removing rollers is disposed such that one lateral edge coincides or overlaps slightly with that of the other pair of releasant removing rollers in the direction at right angles with the sheet feed direction.

12. The fixing device of claim 1, wherein the at least one pair of opposing moving surfaces moves the sheet at the predetermined sheet feed velocity.

13. The fixing device of claim 1, wherein the releasant removing means includes a plurality of pairs of opposing moving surfaces successively disposed in the sheet feed direction.

14. The fixing device of claim 13 for receiving sheets in a range from minimum to maximum width, wherein each of the opposing moving surfaces has two spaced lateral edges extending parallel to the sheet feed direction, and at least one pair of the opposing moving surfaces has one lateral edge disposed from the other a distance greater than a minimum width sheet but less than a maximum width sheet.

15. A fixing device according to claim 13, wherein a reference line is defined by a lateral edge of one of the plurality of pairs of opposing moving surfaces, and a lateral edge of another pair of opposing moving surfaces extends substantially along the reference line.

16. The fixing device of claim 1, wherein:

the releasant removing means has a first opposing moving surface and a second opposing moving surface;

the first opposing moving surface removes releasant material from one side of the sheet while the sheet is moved between the first and second opposing moving surfaces;

releasant material is transferred from the first to the second opposing moving surface when no sheet lies therebetween; and the second opposing moving surface deposits releasant material to the other side of a successive sheet.

17. A fixing device comprising:

a fixing roller and a pressure roller disposed relative to one another for fixing toner to a sheet moving in a sheet feed direction;

releasant applicator means for applying a releasant material to at least one of either the fixing roller or the pressure roller; and a releasant removing means including a plurality of pairs of rollers successively disposed in the sheet feed direction for redistributing releasant on the sheet and each successive sheet, wherein the plurality of pairs of releasant removing rollers are alternatively displaced with axes perpendicular to the sheet feed direction.

18. The fixing device of claim 17, wherein the fixing device is operable to receive sheets having a width range between a maximum width and a minimum width, and one of the plurality of pairs of rollers has a length less than the maximum sheet width but greater than the minimum sheet width.

19. The fixing device of claim 17, wherein one pair of releasant removing rollers is disposed such that one lateral edge at least coincides or overlaps slightly with that of the other pair of releasant removing rollers in a direction at right angles to the sheet feed direction.

20. An image recording device having a fixing device wherein toner is fixed to a sheet which moves through the fixing device at a predetermined sheet velocity in a sheet feed direction, comprising:

a developing unit for depositing toners from a plurality of colors onto the sheet in a superimposing manner;

a fixing roller and a pressure roller disposed relative to one another for fixing toner onto the sheet passing therebetween;

a releasant applicator means for applying releasant material to either the fixing roller or the pressure roller; and releasant removing means including a pair of opposing moving surfaces for moving the sheet in the sheet feed direction, and at least one of the opposing moving surface being an elastomeric surface for redistributing the releasant material on the sheet and each successive sheet.

21. A fixing device wherein toner is fixed to a sheet which moves through the fixing device at a predetermined sheet velocity in a sheet feed direction, comprising:

a fixing roller and a pressure roller disposed relative to one another for fixing toner onto the sheet passed therebetween at the sheet velocity;

a releasant applicator means for applying releasant material to one of either the fixing roller or the pressure roller;

releasant removing means having a plurality of pairs of releasant removing rollers for rotation with respect to each other, each pair being disposed relative to one another in a sheet feed direction for moving the sheet therebetween, and at least one of the rollers of each of the plurality of pairs of releasant removing rollers having an elastomeric surface for removing the releasant material;

wherein the plurality of pairs of releasant removing rollers are alternatively displaced in a direction at right angles with the sheet feed direction; and wherein the fixing device is operable to receive sheets having a width range between a maximum width and a minimum width, and one of the plurality of pairs of releasant removing rollers has a length less than the maximum sheet width but greater than the minimum sheet width.

22. A fixing device wherein toner is fixed to a sheet which moves through the fixing device at a predetermined sheet velocity in a sheet feed direction, comprising:

a fixing roller and a pressure roller disposed relative to one another for fixing toner onto the sheet passed therebetween at the sheet velocity;

a releasant applicator means for applying releasant material to one of either the fixing roller or the pressure roller;

releasant removing means having a plurality of pairs of releasant removing rollers for rotation with respect to each other, each pair being disposed relative to one another in a sheet feed direction for moving the sheet therebetween, and at least one of the rollers of each of the plurality of pairs of releasant removing rollers having an elastomeric surface for removing the releasant material;

wherein the plurality of pairs of releasant removing rollers are alternatively displaced in a direction at right angles with the sheet feed direction; and wherein one pair of releasant removing rollers is disposed such that one lateral edge coincides or overlaps slightly with that of the other pair of releasant removing rollers in the direction at right angles with the sheet feed direction.

23. A fixing device wherein toner is fixed to a sheet which moves through the fixing device at a predetermined sheet velocity in a sheet feed direction, comprising:

a fixing roller and a pressure roller disposed relative to one another for fixing toner onto the sheet passed therebetween at the sheet velocity;

a releasant applicator means for applying releasant material to one of either the fixing roller or the pressure roller;

releasant removing means having a plurality of pairs of opposing moving surfaces successively disposed in the sheet feed direction for moving the sheet therebetween, and at least one of the opposing moving surfaces of each of the plurality of pairs of opposing moving surfaces having an elastomeric surface for removing the releasant material; and wherein a reference line is defined by a lateral edge of one of the plurality of pairs of opposing moving surfaces, and a lateral edge of another pair of opposing moving surfaces extends substantially along the reference line.

24. A fixing device comprising:

a fixing roller and a pressure roller disposed relative to one another for fixing toner to a sheet moving in a sheet feed direction;

releasant applicator means for applying a releasant material to at least one of either the fixing roller or the pressure roller;

a releasant removing means including a plurality of pairs of releasant removing rollers successively disposed in the sheet feed direction for removing releasant from the sheet;

wherein the plurality of pairs of releasant removing rollers are alternatively displaced with axes perpendicular to the sheet feed direction; and wherein the fixing device is operable to receive sheets having a width range between a maximum width and a minimum width, and one of the plurality of pairs of rollers has a length less than the maximum sheet width but greater than the minimum sheet width.

25. A fixing device comprising:

a fixing roller and a pressure roller disposed relative to one another for fixing toner to a sheet moving in a sheet feed direction;

releasant applicator means for applying a releasant material to at least one of either the fixing roller or the pressure roller;

a releasant removing means including a plurality of pairs of releasant removing rollers successively disposed in the sheet feed direction for removing releasant from the sheet;

wherein the plurality of pairs of releasant removing rollers are alternatively displaced with axes perpendicular to the sheet feed direction; and wherein one pair of releasant removing rollers is disposed such that one lateral edge at least coincides or overlaps slightly with that of the other pair of releasant removing rollers in a direction at right angles to the sheet feed direction.

* * * * *